US008783680B2

(12) United States Patent
Lo et al.

(10) Patent No.: US 8,783,680 B2
(45) Date of Patent: Jul. 22, 2014

(54) PAPER OUTPUT STRUCTURE OF PRINTER

(71) Applicant: Hon Hai Precision Industry Co., Ltd., New Taipei (TW)

(72) Inventors: Wen-Chung Lo, New Taipei (TW); Pan-Chih Liu, New Taipei (TW); Chang-Hsiu Wu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/893,324

(22) Filed: May 13, 2013

(65) Prior Publication Data

US 2014/0008862 A1 Jan. 9, 2014

(30) Foreign Application Priority Data

Jul. 3, 2012 (TW) ..... 101123823 A

(51) Int. Cl.
*B65H 29/34* (2006.01)

(52) U.S. Cl.
USPC ..... 271/213; 271/214

(58) Field of Classification Search
USPC ..... 271/207, 213, 214, 278; 347/104; 400/647
See application file for complete search history.

(56) References Cited

U.S. PATENT DOCUMENTS

| | | | | |
|---|---|---|---|---|
| 6,742,949 | B2 * | 6/2004 | Youn | 400/647.1 |
| 7,584,959 | B2 * | 9/2009 | Kinoshita et al. | 271/214 |
| 7,631,865 | B2 * | 12/2009 | Okuda | 271/213 |
| 2006/0012114 | A1 * | 1/2006 | Ko | 271/315 |
| 2012/0161389 | A1 * | 6/2012 | Peters et al. | 271/253 |

* cited by examiner

*Primary Examiner* — Kaitlin Joerger
(74) *Attorney, Agent, or Firm* — Novak Druce Connolly Bove + Quigg LLP

(57) ABSTRACT

A paper output structure includes a printer enclosure and a paper output extending device. The paper output extending device includes a pivot shaft, a drive gear, and a toothed bar which is capable of internal telescopic extension by means of a drive gear which includes a great gear portion and a first small gear portion. A printed sheet of paper is slightly stretched so as to be dropped uncrinkled and perfectly flat into the output tray.

19 Claims, 4 Drawing Sheets

PAPER OUTPUT STRUCTURE OF PRINTER

BACKGROUND

1. Technical Field

The present disclosure relates to printers, particularly to a paper output structure of a printer.

2. Description of Related Art

A paper becomes weak in a printer after it is printed, especially in an ink-jet printer which can make the paper damp. When the paper is delivered to the paper output structure of the printer, the paper may be crinkled.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
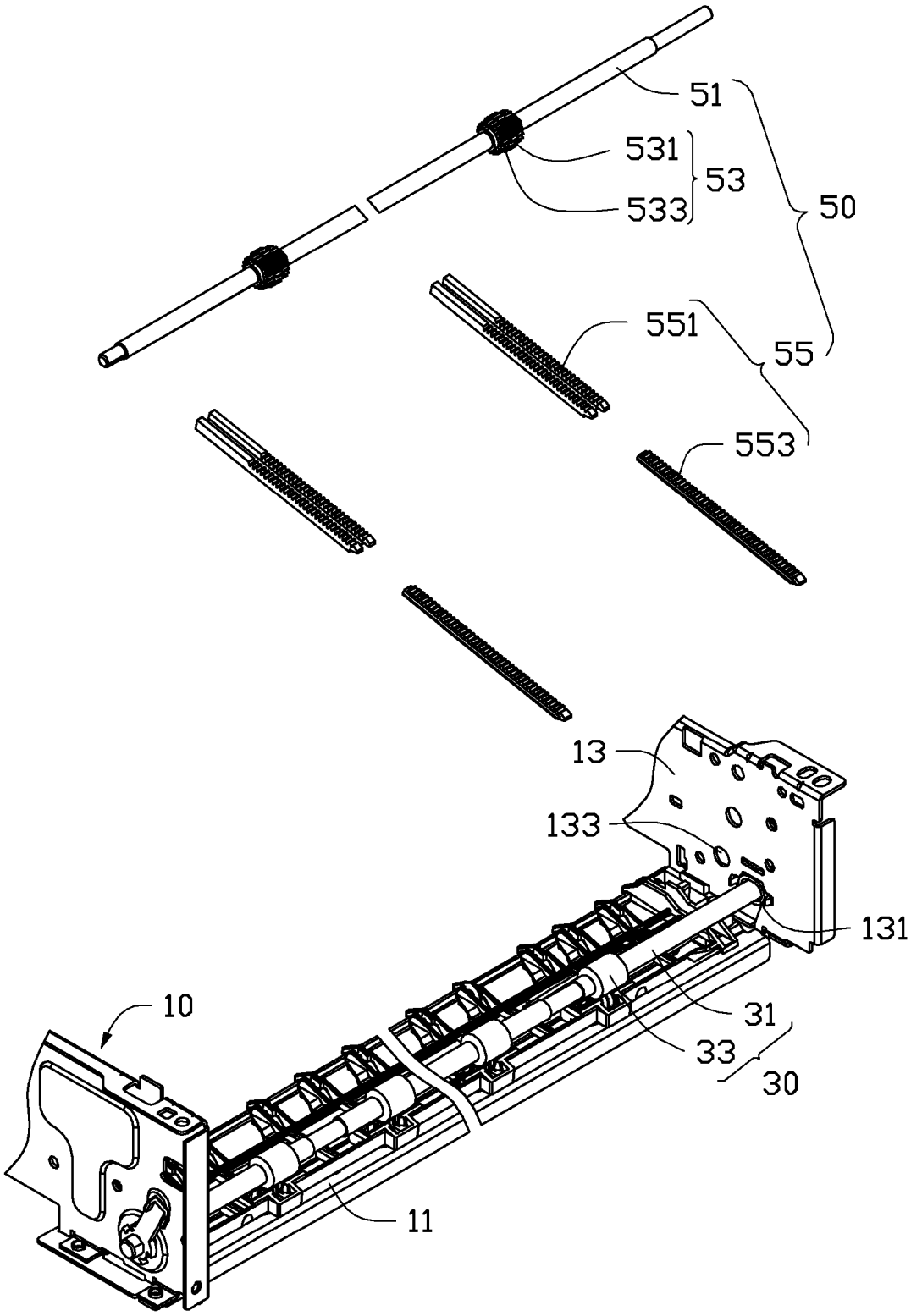
FIG. 1 is an exploded, isometric view of a paper output structure of a printer in accordance with one embodiment of the present disclosure.
Figure 2:
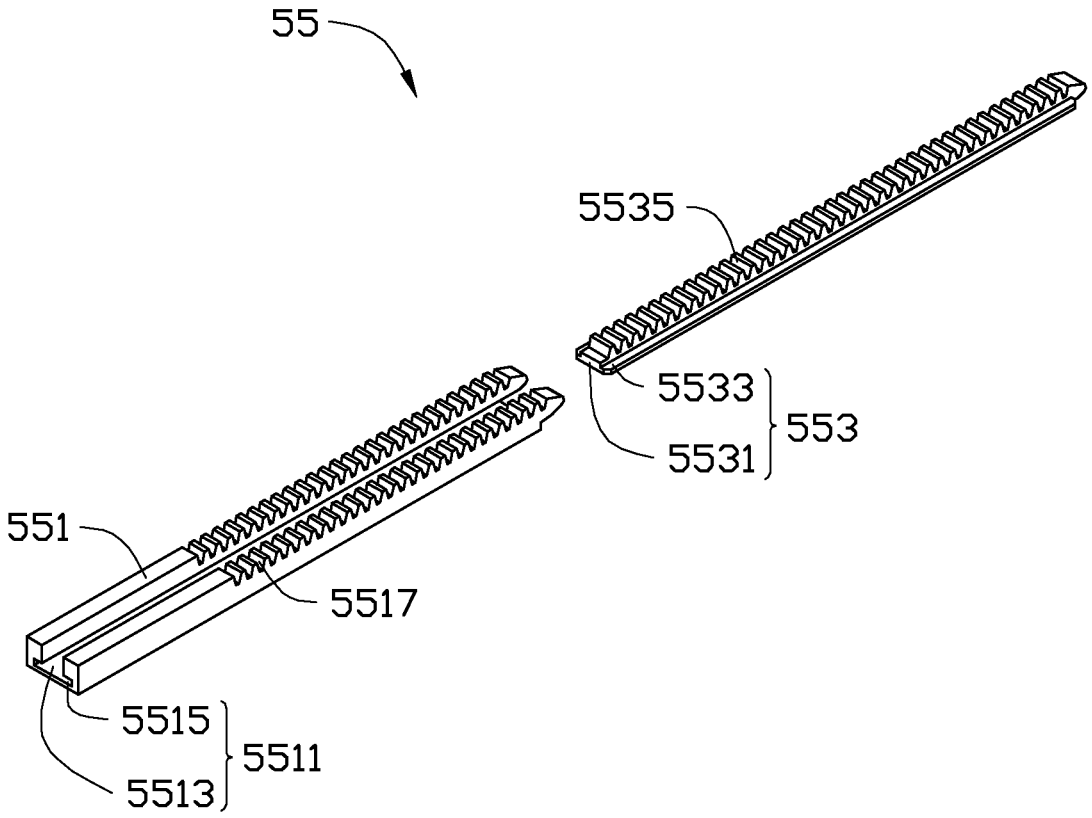
FIG. 2 is an exploded, isometric view of an extending teeth bar of FIG. 1.

FIGS. 1 and 2 show a paper output structure of a printer in accordance with one embodiment. The paper output structure includes a printer enclosure 10 and a paper output shaft 30, and a paper output extending device 50.

The printer enclosure 10 includes a bottom panel 11 and two side panels 13 extending from the bottom panel 11. The two side panels 13 are substantially perpendicular to the bottom panel and substantially parallel to each other. Each side panel 13 defines a first pivot hole 131 and a second pivot hole 133.

The paper output shaft 30 includes a shaft body 31 received in the first pivot hole 131 and a plurality of paper output wheels 33.

The paper output extending device 50 includes a pivot shaft 51, two drive gears 53 mounted on the pivot shaft 51, and two extending teeth bars 55.

Each drive gear 53 includes a great gear portion 531 and two small gear portions 533 placed on opposite sides of the great gear portion 531.

The extending teeth bar 55 includes a first teeth bar 551 and a second teeth bar 553. The first teeth bar 551 defines a slot 5511. The slot 5511 defines a main part 5513 and two sliding parts 5515 communicating with the main part 5513. The cross section of the second teeth bar 553 is T-shaped. The second teeth bar 553 includes a teeth bar body 5531 and two sliding portions 5533 extending from the teeth bar body 5531. The teeth bar body 5531 slides in the main part 5513 of the slot 5511 and the sliding portions 5533 slides in the sliding parts 5515. The first teeth bar 551 includes two lines of first teeth 5517 located on opposite sides of the slot 5511. The two lines of first teeth 5517 are arranged in a first direction. The slot extends in the first direction. The teeth bar body 5531 of the second teeth bar 553 includes a line of second teeth 5535 for engaging the great gear portion 531. The line of second teeth 5535 is also arranged in the first direction.

Figure 3:
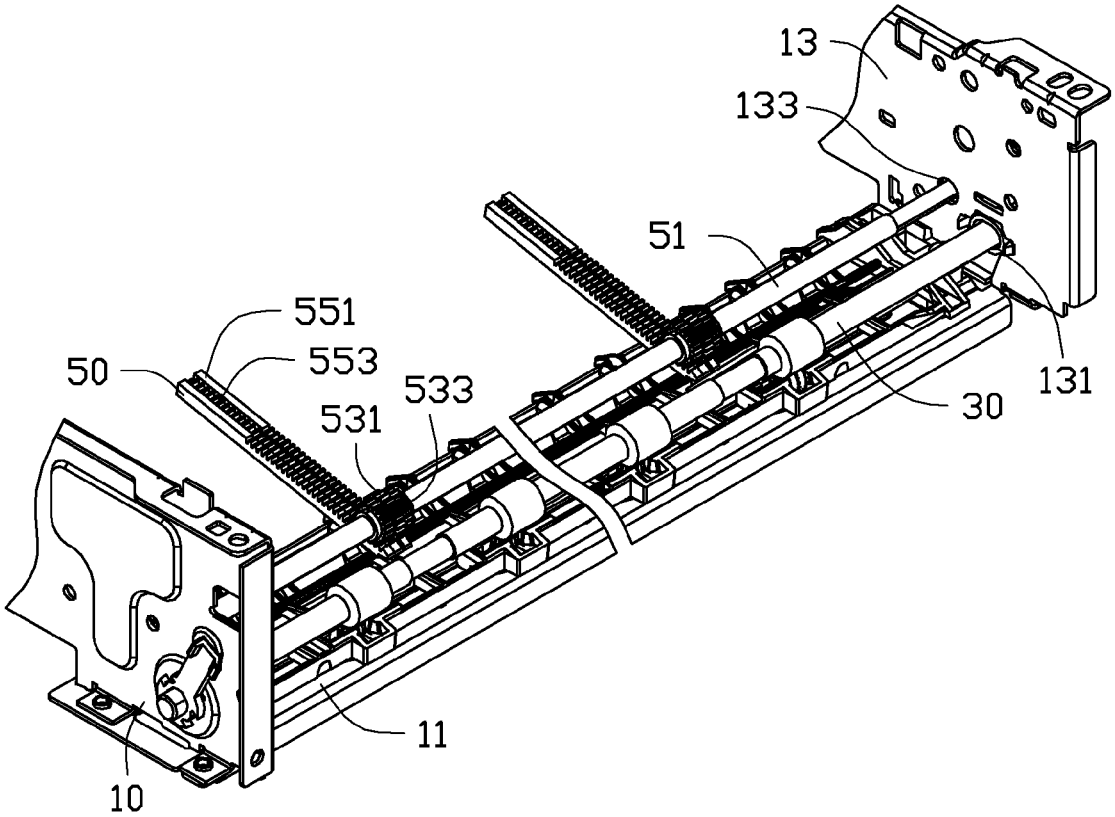
FIG. 3 is an assembled view of the structure of FIG. 1.

FIG. 3 shows assembly, wherein the second teeth bar 553 corresponds to the slot 5511 of the first teeth bar 551 and the sliding portions 5533 of the second teeth bar 553 slide into the sliding parts 5515 of the slot 5511, thereby the second teeth bar 553 is slidably mounted in the first teeth bar 551. The pivot shaft 51 is mounted in the second pivot hole 133 of the printer enclosure 10 and the extending teeth bars 55 are placed under the paper output shaft 30 to engage the drive gear 53. At this time, the first teeth 5517 of the first teeth 551 engage the small gear portion 533 and the second teeth 5535 of the second teeth bar 553 engage the great gear portion 531.

Figure 4:
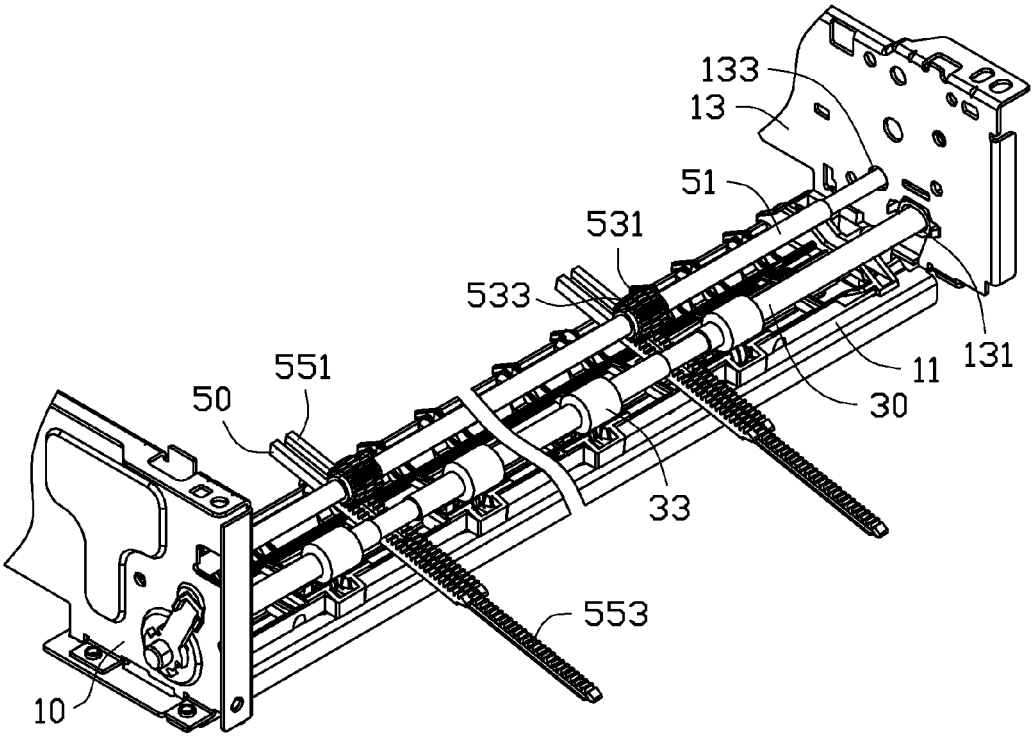
FIG. 4 is another assembled view of the structure of FIG. 1.

Referring to FIG. 4, in use, the pivot shaft 51 of the paper output extending device 50 is rotated by a motor in a first rotation direction when a paper is ready to be output, thereby driving the drive gear 53 to rotate. The drive gear 53 drives the extending teeth bars 55 to move out. The second teeth bar 553 moves faster than the first teeth bar 551 because the diameter of the great gear portion 531 is greater than that of the small gear portion 533, thereby the second teeth bar 553 moves relative to the first teeth bar 551. When a paper is being output, an end of the paper is driven to be placed on the extending teeth bar 55, thereby the extending teeth bar 55 supports the paper. The pivot shaft 51 rotates along a second rotation direction opposite to the first rotation direction to drive the extending teeth bar 55 to move inward when the paper is almost completely output. The second teeth bar 553 moves faster than the first teeth bar 551 when the greater gear portion 531 engages the second teeth bar 553. The second teeth bar 553 moves faster than the first teeth bar 551 until the second teeth bar 553 is received in the slot 5511. Thereby, the paper can be stretched completely flat for being placed on an paper output tray (not shown)

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A paper output structure of a printer, comprising:

a printer enclosure; and a paper output extending device comprising a pivot shaft pivotally mounted to the printer enclosure, a drive gear mounted on the pivot shaft, and an extending teeth bar; the drive gear comprises a great gear portion and a first small gear portion; the extending teeth bar comprises a first teeth bar configured to engage the first small gear portion and a second teeth bar slidably mounted to the first teeth bar; the second teeth bar is configured to engage the great gear portion; the pivot shaft is configured to drive the great gear portion and the first small gear portion to rotate along a rotation direction; and the second teeth bar is configured to slide relative to the first teeth bar when the pivot shaft is driven to rotate.

2. The paper output structure of claim 1, wherein the first teeth bar defines a slot, and the second teeth bar is slidably mounted in the slot.

3. The paper output structure of claim 2, wherein the slot defines a main part and a sliding part communicated with the main part; the second teeth bar comprises a teeth bar body and a sliding portion extending from the teeth bar body; the teeth bar body is received in the main part; and the sliding portion is received in the sliding part.

4. The paper output structure of claim 2, wherein the slot defines a main part and two sliding parts in communication with the main part; the second teeth bar comprises a teeth bar body and two sliding portions extending from the teeth bar body; the teeth bar body is received in the main part; the two sliding portions are received in the two sliding parts; and a cross section of the second teeth bar is T-shaped.

5. The paper output structure of claim 2, wherein the drive gear further comprises a second small gear portion mounted on the pivot shaft; the first small gear portion and the second small gear portion are placed on opposite sides of the great gear portion; and the first teeth bar comprises two lines of first teeth located on opposite sides of the slot to engage the first small gear portion and the second small gear portion.

6. The paper output structure of claim 5, wherein the second teeth bar comprises a line of second teeth configured to engage the great gear portion, and the two lines of first teeth and the line of second teeth are arranged in the same direction.

7. The paper output structure of claim 1, wherein the printer enclosure comprises a bottom panel and two side panels extending from the bottom panel; each of the two side panels defines a pivot hole; and the pivot shaft is pivotally mounted in the pivot hole.

8. The paper output structure of claim 7, wherein the two side panels are substantially parallel to each other and are substantially perpendicular to the bottom panel.

9. The paper output structure of claim 1, further comprising a paper output shaft, wherein the paper output shaft is configured to drive a paper to move out of the printer.

10. The paper output structure of claim 9, wherein the paper output shaft comprises a shaft body and a plurality of paper output wheels mounted on the shaft body.

11. A paper output structure of a printer, comprising:

a printer enclosure, the printer enclosure comprises a bottom panel and two side panels extending from the bottom panel; and a paper output extending device, the paper output extending device comprises a pivot shaft pivotally mounted between the two side panels, a drive gear mounted on the pivot shaft, and an extending teeth bar mounted between the pivot shaft and the bottom panel; the drive gear engages the extending teeth bar; and the drive gear is configured to drive the extending teeth bar to move to support a paper which moves out of the paper out put structures;

wherein the drive gear comprises a great gear portion and a first small gear portion; the extending teeth bar comprises a first teeth bar engaging the first small gear portion and a second teeth bar slidably mounted to the first teeth bar; the second teeth bar engage the great gear portion; the pivot shaft is configured to drive the great gear portion and the first small gear portion to rotate along a rotation direction; the second teeth bar is configured to slide relative to the first teeth bar when the pivot shaft is driven to rotate.

12. The paper output structure of claim 11, wherein the first teeth bar defines a slot, and the second teeth bar is slidably mounted in the slot.

13. The paper output structure of claim 12, wherein the slot defines a main part and a sliding part in communication with the main part; the second teeth bar comprises a teeth bar body and a sliding portion extending from the teeth bar body; the teeth bar body is received in the main part; and the sliding portion is received in the sliding part.

14. The paper output structure of claim 12, wherein the slot defines a main part and two sliding parts communicated with the main part; the second teeth bar comprises a teeth bar body and two sliding portions extending from the teeth bar body; the teeth bar body is received in the main part; the two sliding portions are received in the two sliding parts; and a cross section of the second teeth bar is T-shaped.

15. The paper output structure of claim 12, wherein the drive gear further comprises a second small gear portion mounted on the pivot shaft; the first small gear portion and the second small gear portion are placed on opposite sides of the great gear portion; and the first teeth bar comprises two lines of first teeth located on opposite sides of the slot to engage the first small gear portion and the second small gear portion.

16. The paper output structure of claim 15, wherein the second teeth bar comprises a line of second teeth configured to engage the great gear portion, and the two lines of first teeth and the line of second teeth are arranged in the same direction.

17. The paper output structure of claim 11, wherein each of the two side panels defines a pivot hole, and the pivot shaft is pivotally mounted in the pivot hole.

18. The paper output structure of claim 17, wherein the two side panels are substantially parallel to each other and are substantially perpendicular to the bottom panel.

19. The paper output structure of claim 11, further comprising a paper output shaft, wherein the paper output shaft comprises a shaft body and a plurality of paper output wheels mounted on the shaft body, and the paper output shaft is configured to drive a paper to move out of the printer.

* * * * *